United States Patent [19]

Miller

[11] 4,373,223

[45] Feb. 15, 1983

[54] CONTAINER OPENER

[75] Inventor: Lester Miller, Hopkins, Mich.

[73] Assignee: Mildoy Enterprises, Hopkins, Mich.

[21] Appl. No.: 116,566

[22] Filed: Jan. 29, 1980

[51] Int. Cl.[3] ..... B25F 1/00; B67B 7/44

[52] U.S. Cl. ..... 7/151; 81/3.1 R; 81/3.46 R; 431/253; 131/185

[58] Field of Search ..... 7/151, 167; 81/3.1 R, 81/3.34, 3.46 R; D27/36, 38; 131/185, 234; D8/33, 34, 40; 431/142, 202, 253

[56] References Cited

U.S. PATENT DOCUMENTS

| | | | |
|---|---|---|---|
| D. 156,639 | 12/1949 | Love . | |
| D. 170,767 | 11/1953 | Polk . | |
| D. 172,108 | 5/1954 | Polingovsky . | |
| 999,901 | 8/1911 | Stephens | 81/3.46 R |
| 1,755,086 | 4/1930 | Tapp | 81/3.1 R |
| 2,413,082 | 12/1946 | Skaer | 81/3.46 R |
| 2,496,840 | 2/1950 | Alexander . | |
| 2,585,071 | 2/1952 | Allen . | |
| 2,633,137 | 3/1953 | Narragon . | |
| 2,691,287 | 10/1954 | Mosch . | |
| 2,745,301 | 5/1956 | Grunwald | 81/3.1 |
| 2,828,855 | 4/1958 | Mosch . | |
| 3,286,874 | 11/1966 | Bozek | 81/3.1 |
| 4,034,595 | 7/1977 | Smith | 7/151 |
| 4,253,352 | 3/1981 | O'Neal | 81/3.46 R |

FOREIGN PATENT DOCUMENTS

| | | | |
|---|---|---|---|
| 1067570 | 1/1954 | France | 81/3.46 R |
| 1300281 | 6/1962 | France | 431/142 |

*Primary Examiner*—Roscoe V. Parker

*Attorney, Agent, or Firm*—Waters, Lesniak & Willey

[57] ABSTRACT

A container opener comprises an elongated plastic body having a hollow internal chamber, open at one end, such that a disposable cigarette lighter may be snugly inserted into the chamber. The opener has a recessed opening at the opposite end with its inner wall having a slot of a size and shape to receive the tab of a tab-top beverage container so that the container may be opened by upwardly pivoting the opener relative to the container. The recessed opening at the end of the container opener also provides a crown cap removing mechanism for removing a crown cap on a beverage bottle.

10 Claims, 10 Drawing Figures

CONTAINER OPENER

BACKGROUND OF THE INVENTION

1. Field of the Invention

The present invention relates to a container opener including a tab-top can opener and a crown cap bottle opener and more particularly to an opener of this type incorporated into a case for a disposable cigarette lighter.

2. Description of the Prior Art

Container openers designed to remove crown caps from bottles or cans have been incorporated into various devices in the past. Examples of such devices include drinking glasses and other fluid containers having prying devices attached to or incorporated into their bases and jack knives with fold-out bottle openers.

One disadvantage with the above type of devices is that they are sometimes inconvenient to use and carry on one's person and they do not include a device for opening tab-top containers.

An objective of the present invention is to provide a compact, convenient device which may be used to open both containers having crown caps and containers having tab-tops. A further object of the present invention is to provide such a device in a form which is conveniently carried on the user's person without adding to his or her collection of usually-carried paraphernalia.

SUMMARY OF THE INVENTION

In accordance with the present invention, a container opener comprises an elongated body having an internal, hollow chamber with an opening at one end such that a disposable lighter may be inserted longitudinally into the chamber.

A slot is formed in the body such that a tab of a tab-top container will fit in the slot and the container can be opened by pivoting the opener relative to the container with the tab in the slot.

The opening for the lighter is formed such that when the lighter is inserted in the opening, the striker wheel and flame end of the lighter (i.e., the flame producing mechanism) protrudes from the open end of the hollow chamber. A recessed opening is located at the end of the body opposite the hollow chamber. The recessed opening includes the slot for the tab on the tab-top container.

The wall around the recessed opening provides the crown cap opener of the present invention. One side of the wall constitutes a fulcrum portion that fits over the cap and engages the top thereof, and the other side of the wall constitutes a prying portion that fits under and engages the lower edge of the cap. A raised lip on the prying portion grips the edge of the cap.

In one aspect of the present invention, the tab-top slot is cut into the edge of one of the walls of the recessed opening. Alternatively, the slot is formed between the wall of the body and a retainer wall located on the inner wall of the recessed opening.

In the preferred embodiment, the container opener is plastic, with a reinforcing band in the form of a metal insert molded into the surface of the inner wall of the recessed opening. The insert extends over the inner wall surface of the fulcrum and prying portions that contact the crown cap, so as to provide a durable bearing surface for engaging crown caps on containers.

In one aspect of the present invention the container opener is incorporated in a case that holds a disposable cigarette lighter. In another aspect of the present invention, the container opener is formed as an integral part of the body of the cigarette lighter itself. In still another aspect of the present invention, the container opener is formed as a separate member and includes no case for a cigarette lighter.

These and other features and advantages of the present invention will become apparent from the illustration embodiments of the present invention described below and shown in the appended drawings.

DETAILED DESCRIPTION OF THE PREFERRED EMBODIMENTS

Figure 1:
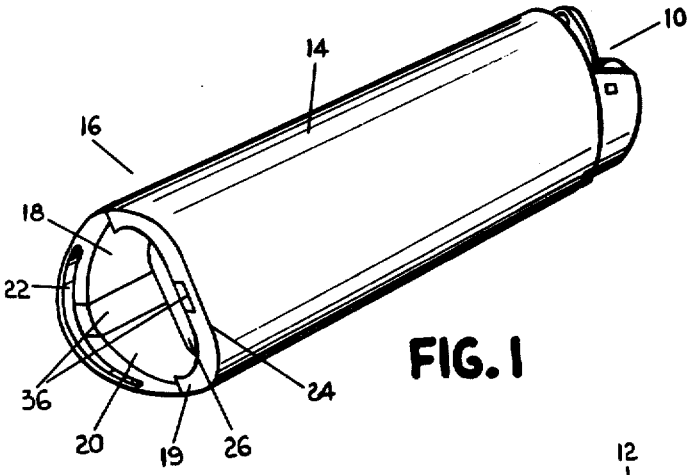
FIG. 1 is a perspective view of the preferred embodiment, showing the disposable cigarette lighter inserted into the container opener.
Figure 3:
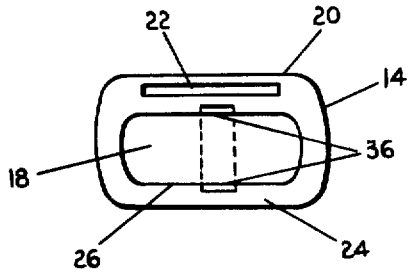
FIG. 3 is an end view, showing the recessed opening containing the tab slot and crown cap removal means.
Figure 2:
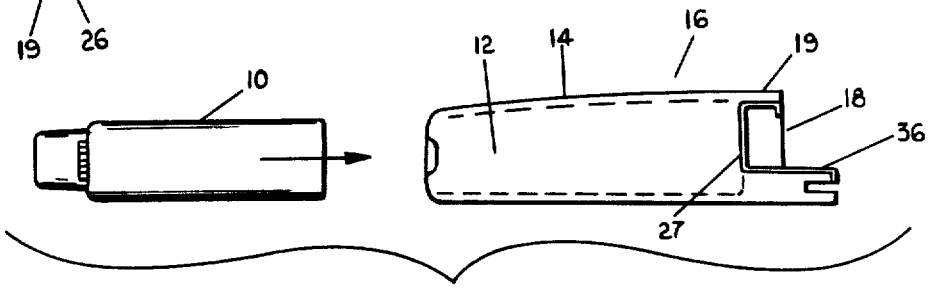
FIG. 2 is a side view of the preferred embodiment showing the disposable cigarette lighter removed from the container opener.
Figure 4:
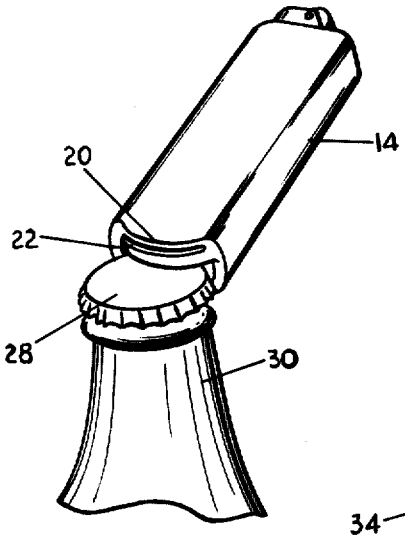
FIG. 4 illustrates the crown cap removal means on the preferred embodiment engaging a crown cap on a beverage container.
Figure 5:
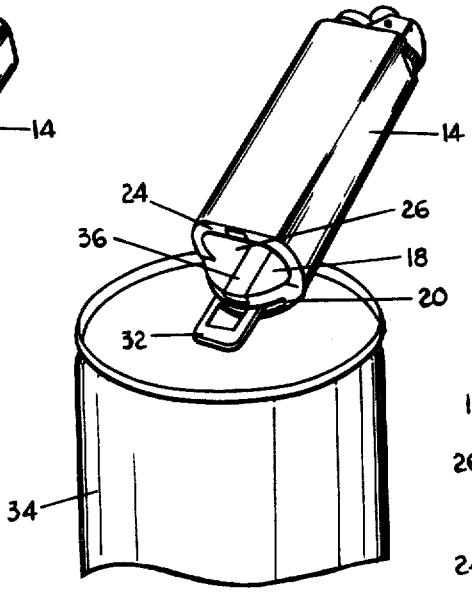
FIG. 5 illustrates the tab slot of the preferred embodiment slideably engaging the tab on a tab-top container.

Referring now to the drawings, in FIGS. 1 through 5, a disposable lighter 10 may be snugly inserted into hollow chamber 12 at one end of body 14 of container opener 16. Body 14 has at its opposite end a recessed opening 18 with a wall 19 extending around the recessed opening. A fulcrum portion 20 of the wall extends outwardly from body 14. A slot 22 for opening tab-tops is formed in fulcrum portion 20. The portion of the wall on the opposite side of opening 18 also comprises a prying portion 24, containing raised lip 26 for engaging the lower edge of crown cap 28 on a container 30. When body 14 is pivoted upwardly with respect to container 30, crown cap 28 is pryed loose and removed.

Slot 22 in FIGS. 1 through 5 engages tab 32 on non-removable tab-top container 34, such that when body 14 is pivoted upwardly with respect to container 34, tab 32 is pryed upwardly and the container 34 is opened.

Figure 6:
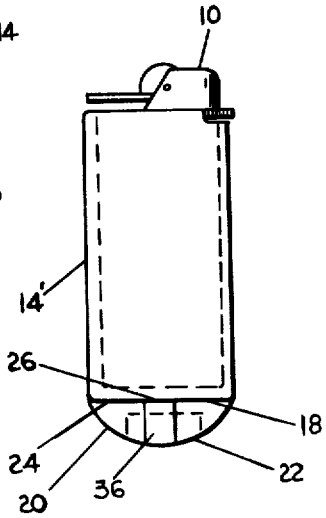
FIG. 6 is a top view of an alternative embodiment of the present invention wherein the tab slot and crown cap removal means are incorporated into the body of the cigarette lighter.

In FIG. 6, an alternative embodiment is illustrated, wherein body 14' comprises the body of a plastic cigarette lighter. At the end of body 14' is recessed opening 18 with a longitudinally extending wall 19'. Fulcrum portion 20' and prying portion 24' are formed at opposite sides of the recessed portion, as described above, and slot 22' is formed in prying portion 24', with raised lip 26' extending inwardly from the wall at the lower edge thereof.

In all of FIGS. 1 through 6, a metal insert 36, formed of steel or the like, is molded into the plastic body 14 (or 14') in the inner surface of the wall around recessed opening 18, to provide a bearing surface for engaging crown cap 28.

The metal insert is in the form of a reinforcing member or band extending longitudinally along the lever portion, through the bottom end 27 of the case, transversely across the end to the prying portion, and then outwardly along the prying portion. A lip is formed on the end of the reinforcing band to engage the lower edge of the crown cap.

Figure 7:
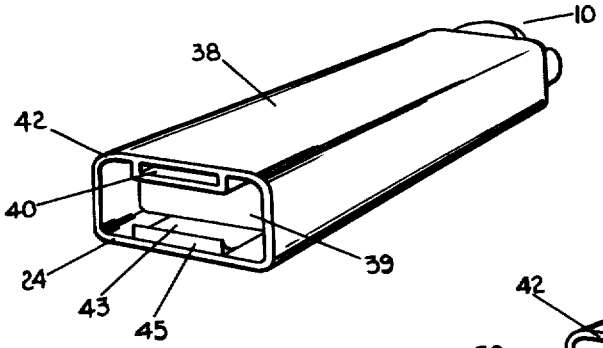
FIG. 7 is a perspective view of an alternative embodiment of the present invention without the longitudinally extending portion of the wall of the recessed opening incorporated into the body of a cigarette lighter.

FIGS. 7 through 10 illustrate an alternative embodiment of the present invention. In FIG. 7, container opener body 38 is incorporated as an integral part of the body of disposable lighter 10' and includes recessed opening 39 at one end. Recessed opening 39 includes tab slot 40 located on its inner wall 42. Metal insert 43 is molded into the opposite wall of body 38 to provide the raised lip 45 for engaging the lower edge of crown cap 28.

Figure 8:
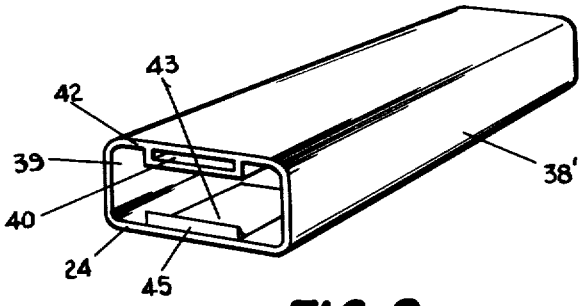
FIG. 8 is an alternative embodiment of the present invention without the longitudinally extending portion of the wall of the recessed opening incorporated into a case for receiving a disposable cigarette lighter.

In FIG. 8, the present invention is illustrated with container opener body 38', with no disposable cigarette ligher inserted into its hollow chamber. Recessed opening 39 and its parts are identical to those shown in FIG. 7 incorporated in the body of disposable lighter 10'.

Figure 9:
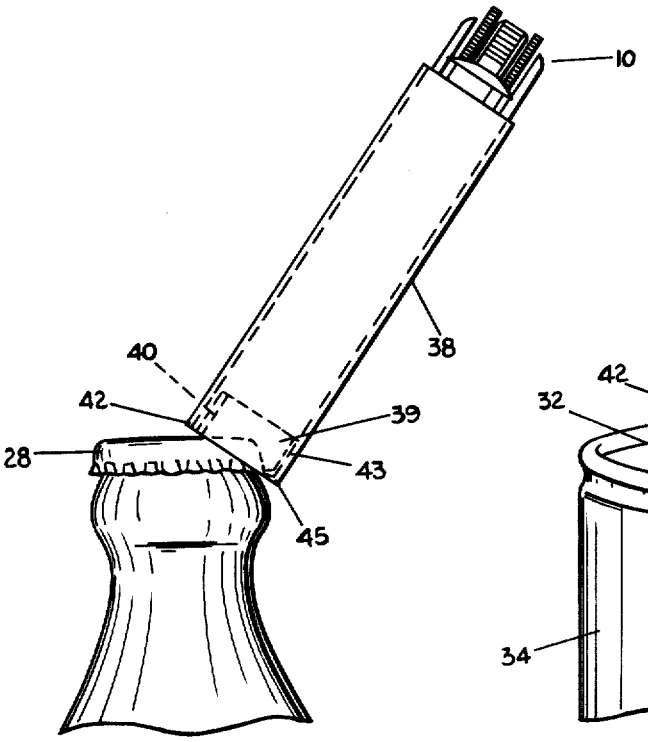
FIG. 9 illustrates the alternative embodiment shown in FIG. 7 and FIG. 8, engaging a crown cap on a beverage container.
Figure 10:
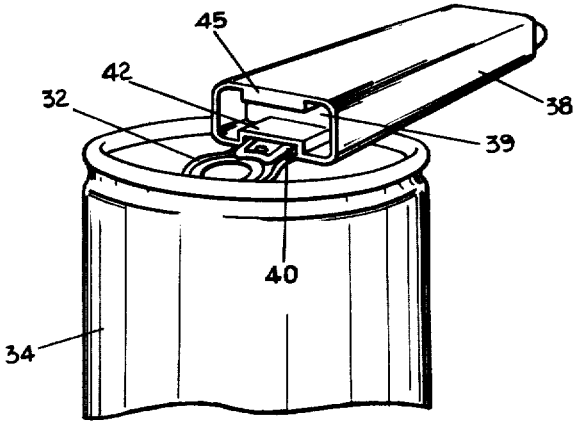
FIG. 10 illustrates the alternative embodiment described and shown in FIG. 7 and FIG. 8 with its tab slot engaging the tab on the tab-top beverage container.

In FIGS. 9 and 10, the present invention is shown engaging crown cap 28 on container 30 and tab 32 on container 34 respectively.

It should be understood that the foregoing represent merely exemplary embodiments of the present invention and that various changes and modifications may be made in the arrangements and details of construction of the elements described and shown above without departing from the spirit and scope of the present invention.

The embodiments of the invention in which an exclusive property or privilege is claimed are defined as follows:

1. A combination container opener and lighter case comprising an elongated body having an internal hollow chamber with an opening at one end of the body such that a disposable lighter may be inserted longitudinally into the chamber, and further having a slot on the body such that a tab of a tab-top container will fit in the slot and the container can be opened by pivoting the opener relative to the container with the tab in the slot, the slot comprising a longitudinal opening at the end of the body opposite the opening for the lighter, a portion of the container opener at one edge of the slot fitting under the tab such that the tab can be slipped into the slot to open the container, the container opener further comprising crown cap removal means for removing a crown cap from a container, the crown cap removal means being located in a recessed opening at the end of the body opposite the one end in which the lighter is mounted, the crown cap removal means comprising a fulcrum portion on one side of a wall extending around the recessed opening and a prying portion on the opposite side of the wall of the recessed opening, with the prying portion including an inwardly extending raised lip on the inside surface of the wall, the fulcrum and prying portions being formed such that the opener may be placed on a crown cap in such a manner that the raised lip engages a bottom edge of the crown portion of the crown cap and the fulcrum portion engages, and extends partially across, the top surface of the crown cap such that when the opener is pivoted upwardly with respect to the container, the crown cap is removed.

2. A combination container opener and lighter comprising a body, a lighter mounted in one end of the body, and a tab-top can opener incorporated in the body, the tab-top can opener comprising a slot shaped such that a tab of a tab-top container will fit in the slot and the container can be opened by pivoting the opener relative to the container with the tab in the slot, the slot comprising a longitudinal opening at the end of the body opposite the opening for the lighter, a portion of the container opener at one edge of the slot fitting under the tab such that the tab can be slipped into the slot to open the container, the container opener further comprising crown cap removal means for removing a crown cap from a container, the crown cap removal means being located in a recessed opening at the end of the body opposite the one end in which the lighter is mounted, the crown cap removal means comprising a fulcrum portion on one side of a wall extending around the recessed opening and a prying portion on the opposite side of the wall of the recessed opening, with the prying portion including an inwardly extending raised lip on the inside surface of the wall, the fulcrum and prying portions being formed such that the opener may be placed on a crown cap in such a manner that the raised lip engages a bottom edge of the crown portion of the crown cap and the fulcrum portion engages, and extends partially across, the top surface of the crown cap such that when the opener is pivoted upwardly with respect to the container, the crown cap is removed.

3. A container opener according to claim 1 or 2, wherein the slot comprises a longitudinal opening in the end edge of the wall extending around the recessed opening.

4. A container opener according to claim 1 or 2, wherein the body is formed of a moldable plastic and the crown cap removal means further comprises a metal insert attached to the inner surface of the wall of the recessed opening, the metal insert extending over the inner surface of the fulcrum portion of the wall and over the raised lip on the prying portion of the wall so as to provide metal bearing surfaces reinforcing the portions of the body that engage the crown cap.

5. A combination container opener and lighter comprising a body, a lighter mounted in one end of the body, and a tab-top can opener incorporated in the body, the tab-top can opener comprising a slot shaped such that a tab of a tab-top container will fit in the slot and the container can be opened by pivoting the opener relative to the container with the tab in the slot, the slot comprising a longitudinal opening at the end of the body opposite the opening for the lighter, a portion of the container opener at one edge of the slot fitting under the tab such that the tab can be slipped into the slot to open the container, the container opener further comprising crown cap removal means for removing a crown cap from a container, the crown cap removal means being located in a recessed opening at the end of the body opposite the one end in which the lighter is mounted, the slot comprising a longitudinal opening in an end edge of a wall extending around the recessed opening.

6. A combination container opener and lighter comprising a body, a lighter mounted in one end of the body, and a tab-top can opener incorporated in the body, the tab-top can opener comprising a slot shaped such that a tab of a tab-top container will fit in the slot and the container can be opened by pivoting the opener relative to the container with the tab in the slot, the slot comprising a longitudinal opening at the end of the body opposite the opening for the lighter, a portion of the container opener at one edge of the slot fitting under the tab such that the tab can be slipped into the slot to open the container, the container opener further comprising crown cap removal means for removing a crown cap from a container, the crown cap removal means being located in a recessed opening at the end of the body opposite the one end in which the lighter is mounted, the slot being formed by a wall of the body and a retaining wall attached to the inside surface of the body wall at the end of the body in which the recessed opening is formed, the retaining wall being separated from the wall of the body by a distance sufficient to accommodate a tab of a container therebetween.

7. A combination lighter case for a disposable lighter and container opener comprising:

an elongated body formed of a moldable plastic material, the body including an opening at one end such that the disposable lighter can fit snugly therein with the flame producing portion of the lighter protruding out of the opening, the opening conforming generally to the shape of the lighter and being sufficiently small that the lighter does not come out of the opening unless it is pulled out by the user, the body having a recessed portion in the other end thereof, with an end portion of the body separating the opening and the recessed portion and a wall of the body extending around the periphery of the recessed portion;

a tab-top can opening means incorporated into the body for opening non-removable tab-top cans of the type wherein a can is opened by pivoting a tab on the top of the can in an upward direction, the can opening means comprising a slot formed in the body that fits over the tab and permits the can to be opened by pivoting the body upwardly with the tab in the slot;

a crown cap opening means incorporated into the recessed portion of the body for removing crown caps from containers, the crown cap opening means comprising a fulcrum portion that fits over and engages the top of the crown cap and a prying portion that fits under and engages the lower edge of the crown cap such that the crown cap can be removed by pivoting the body such that the fulcrum portion is pressed downwardly on the top of the cap while the prying portion is pressed upwardly on the lower edge of the cap, a portion of the wall on one side of the recessed portion forming the prying portion and the portion of the wall on the other side of the recessed portion forming the fulcrum portion, the prying portion including an inwardly extending lip that fits under the lower edge of the crown cap for gripping engagement therewith, the crown cap removal means further comprising a metal reinforcing band in the fulcrum and prying portions, the metal reinforcing band extending longitudinally into the recessed opening along the inner surface of the fulcrum portion of the wall to the end portion of the body and then extending across the end portion to the opposite side of the body, the reinforcing band thereafter extending longitudinally along the prying portion out of the recessed opening, the reinforcing band including a metal lip at the outer end thereof that serves as a gripping surface where the prying portion engages the lower edge of the crown cap, the slot for the tab-top can opener being formed in the fulcrum portion of the wall extending around the recessed portion of the body, the slot extending longitudinally into the wall in a direction parallel to the wall from a lower end edge of the fulcrum portion, the slot being formed such that the wall portion between the slot and the outer surface of the wall is sufficiently thin to fit under the tab of the tab-top container, the slot fitting sufficiently close over the tab such that upward pivotal movement of the body with the tab in the slot causes the tab to pivot upwardly so as to open the can.

8. A combination container opener and lighter case comprising an elongated body having an internal hollow chamber with an opening at one end of the body such that a disposable lighter may be inserted longitudinally into the chamber, and further having a slot on the body such that a tab of a tab-top container will fit in the slot and the container can be opened by pivoting the opener relative to the container with the tab in the slot, the container opener further comprising crown cap removal means located on the body of the lighter for removing a crown cap from a container, the crown cap removal means being located in a recessed opening at the end of the body opposite the one end in which the lighter is mounted, the slot comprising a longitudinal opening in an end edge of a wall extending around the recessed opening.

9. A combination container opener and lighter case comprising an elongated body having an internal hollow chamber with an opening at one end of the body such that a disposable lighter may be inserted longitudinally into the chamber, and further having a slot on the body such that a tab of a tab-top container will fit in the slot and the container can be opened by pivoting the opener relative to the container with the tab in the slot, the container opener further comprising crown cap removal means located on the body of the lighter for removing a crown cap from a container, the crown cap removal means being located in a recessed opening at the end of the body opposite the one end in which the lighter is mounted, the slot being formed by a wall of the body and a retaining wall attached to the inside surface of the body wall at the end of the body in which the recessed opening is formed, the retaining wall being separated from the wall of the body by a distance sufficient to accommodate a tab of a container therebetween.

10. A combination container opener and lighter comprising an elongated body having an internal hollow chamber with an opening at one end of the body such that a disposable lighter may be inserted into the chamber, and further having a tab-top can opener incorporated in the body, the tab-top can opener comprising a slot shaped such that a tab of a tab-top container will fit in the slot and the container can be opened by pivoting the opener relative to the container with the tab in the slot, the container opener further comprising crown cap removal means located on the body of the lighter for removing a crown cap from a container, the crown cap removal means being located in a recessed opening at the end of the body opposite the one end in which the lighter is mounted, the crown cap removal means comprising fulcrum portion on one side of a wall extending around the recessed opening and a prying portion on the opposite side of the wall of the recessed opening, with the prying portion including an inwardly extending raised lip on the inside surface of the wall, the fulcrum and prying portions being formed such that the opener may be placed on a crown cap in such a manner that the raised lip engages a bottom edge of the crown portion of the crown cap and the fulcrum portion engages, and extends partially across, the top surface of the crown cap such that when the opener is pivoted upwardly with respect to the container, the crown cap is removed, the slot comprising a longitudinal opening in the end edge of the wall extending around the recessed opening.

* * * * *